US010280068B2

(12) United States Patent
Schleese

(10) Patent No.: US 10,280,068 B2
(45) Date of Patent: May 7, 2019

(54) ADJUSTABLE WESTERN SADDLE

(71) Applicant: Schleese Saddlery Service Ltd., Holland Landing (CA)

(72) Inventor: Joachim Schleese, Newmarket (CA)

( * ) Notice: Subject to any disclaimer, the term of this patent is extended or adjusted under 35 U.S.C. 154(b) by 219 days.

(21) Appl. No.: 15/190,306

(22) Filed: Jun. 23, 2016

(65) Prior Publication Data

US 2017/0369301 A1 Dec. 28, 2017

(51) Int. Cl.

| | |
|---|---|
| ***B68C 1/04*** | (2006.01) |
| ***B68C 1/12*** | (2006.01) |
| *B68C 1/08* | (2006.01) |

(52) U.S. Cl.

CPC ..... *B68C 1/04* (2013.01); *B68C 1/12* (2013.01); *B68C 1/08* (2013.01); *B68C 2001/044* (2013.01)

(58) Field of Classification Search

CPC ..... B68C 1/02; B68C 1/04; B68C 2001/044; B68C 2001/046; B68C 1/12; B68C 1/126; B68C 1/16

USPC ..... 54/44.1, 44.3, 44.5, 44.7, 46.1

See application file for complete search history.

(56) References Cited

U.S. PATENT DOCUMENTS

| | | | | |
|---|---|---|---|---|
| 2,037,275 A * | 4/1936 | Senderman | B68C 1/025 | 54/44.3 |
| 3,624,695 A | 11/1971 | Roberts | | |
| 4,782,649 A * | 11/1988 | Zubrod | B68C 1/16 | 54/46.2 |
| 4,924,660 A | 5/1990 | Norman | | |
| 5,802,823 A | 9/1998 | Woods | | |
| 6,434,916 B1 * | 8/2002 | Tucker | B68C 1/02 | 54/44.5 |
| 6,588,185 B1 * | 7/2003 | Goblet | B68C 1/02 | 54/44.3 |
| 2005/0120683 A1 * | 6/2005 | Swain | B68C 1/025 | 54/44.1 |
| 2005/0126132 A1 * | 6/2005 | Kempsell | B68C 1/025 | 54/44.1 |
| 2006/0168918 A1 * | 8/2006 | Naslund | B68C 1/02 | 54/44.1 |
| 2009/0282790 A1 * | 11/2009 | Goblet | B68C 1/02 | 54/44.4 |
| 2012/0137640 A1 * | 6/2012 | Diaz | B68C 1/025 | 54/44.3 |

OTHER PUBLICATIONS

ISR and WO for PCT/CA2017/050751.

* cited by examiner

*Primary Examiner* — Lisa L Tsang
(74) *Attorney, Agent, or Firm* — Anderson Gorecki LLP

(57) ABSTRACT

A saddle includes a tree having a rider-facing side and a horse-facing side, a seat cover adapted for detachable installation on the rider-facing side of the tree and an insert adapted for installation between the tree and the seat cover. Conveniently, the insert may adapt the saddle for riders of distinct size and shape and accommodate for physical differences between male and female riders. Furthermore, a connection panel secured to the horse-facing side of the tree may allow for releasably secured panel padding elements that customize the horse-facing side of the tree to a particular horse. Adjustable stirrup bars provide even further flexibility of customization.

15 Claims, 10 Drawing Sheets

ADJUSTABLE WESTERN SADDLE

FIELD

The present application relates generally to saddles and, more specifically, to an adjustable western saddle.

BACKGROUND

The art of saddle design is an old and traditional art that has not changed significantly with the advent of modern technology. However, there appear to be areas of saddle design that may be improved.

BRIEF DESCRIPTION OF THE DRAWINGS

Reference will now be made, by way of example, to the accompanying drawings which show example implementations; and in which.

DETAILED DESCRIPTION

A saddle according to elements of the present application includes a tree having a rider-facing side and a horse-facing side, a seat cover adapted for detachable installation on the rider-facing side of the tree and an insert adapted for installation between the tree and the seat cover. Conveniently, the insert may adapt the fit of the saddle for riders of distinct size and shape and accommodate for physical differences between male and female riders. Furthermore, a connection panel secured to the horse-facing side of the tree may allow for releasably secured padding elements that customize the horse-facing side of the tree to fit a particular horse. Adjustable stirrup bars provide even further flexibility of customization.

According to an aspect of the present disclosure, there is provided a saddle. The saddle includes a tree having a rider-facing side and a horse-facing side, a seat cover adapted for detachable installation on the rider-facing side of the tree and an insert adapted for installation between the tree and the seat cover.

Other aspects and features of the present disclosure will become apparent to those of ordinary skill in the art upon review of the following description of specific implementations of the disclosure in conjunction with the accompanying figures.

The base on which the rest of the saddle is built is called a tree. The tree is usually formed from wood or a similar synthetic material. The tree is eventually covered in leather or leather-like synthetic material. For a fuller discussion of tree design considerations, see U.S. Pat. No. 5,517,808, issued May 21, 1996 to Jochen Schleese and hereby incorporated herein by reference. The tree may be associated with qualities such as arc, width and angle.

Figure 1:
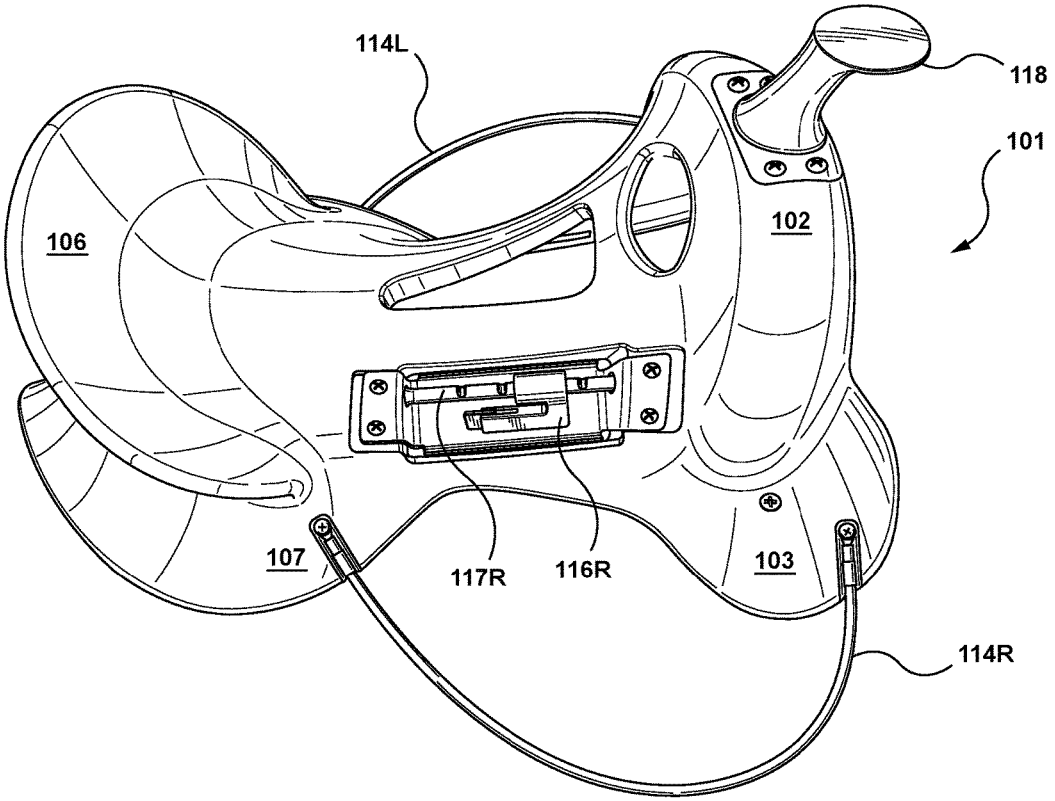
FIG. 1 illustrates, in an upper perspective view, a right side of a saddle tree as a part of a saddle in accordance with an aspect of the present application.

FIG. 1 illustrates, in an upper perspective view, a right side of a saddle tree 101.

The saddle tree 101 may be constructed of a lightweight, non-breakable plastic polymer formed by combining polyurethane and polypropylene. Through experimentation, a material for the saddle tree 101 may be arrived at so that the saddle tree 101 has an amount of give that allows a rider to discern the movement of the horse.

The saddle tree 101 has a swell 102 and a cantle 106. Below the swell 102 is a front-end bar 103. Below the cantle 106 is a rear-end bar 107. A right side cable 114R is illustrated extending from the front-end bar 103 to the rear-end bar 107. Similarly, a left side cable 114L is illustrated extending from the front-end bar 103 to the rear-end bar 107. Installed within an aperture in the right side of the saddle tree 101 is a right side adjustable stirrup bar 116R. Installed within an aperture in the left side of the saddle tree 101 is a left side adjustable stirrup bar 116L. A horn 118 extends from the top of the swell 102.

The right side cable 114R and the left side cable 114L may, for example, be formed of ¼ inch vinyl-coated stainless steel aircraft cable.

The right side cable 114R and left side cable 114L are not part of a loop but, rather, have discrete ends. That is, the right side cable 114R has a front end and a rear end, as does the left side cable 114L. The front end of the right side cable 114R may be anchored within the front-end bar 103 and the rear end of the right side cable 114R may be anchored within the rear-end bar 107. Similarly, The front end of the left side cable 114L may be anchored within the front-end bar 103 and the rear end of the left side cable 114L may be anchored within the rear-end bar 107.

Figure 2:
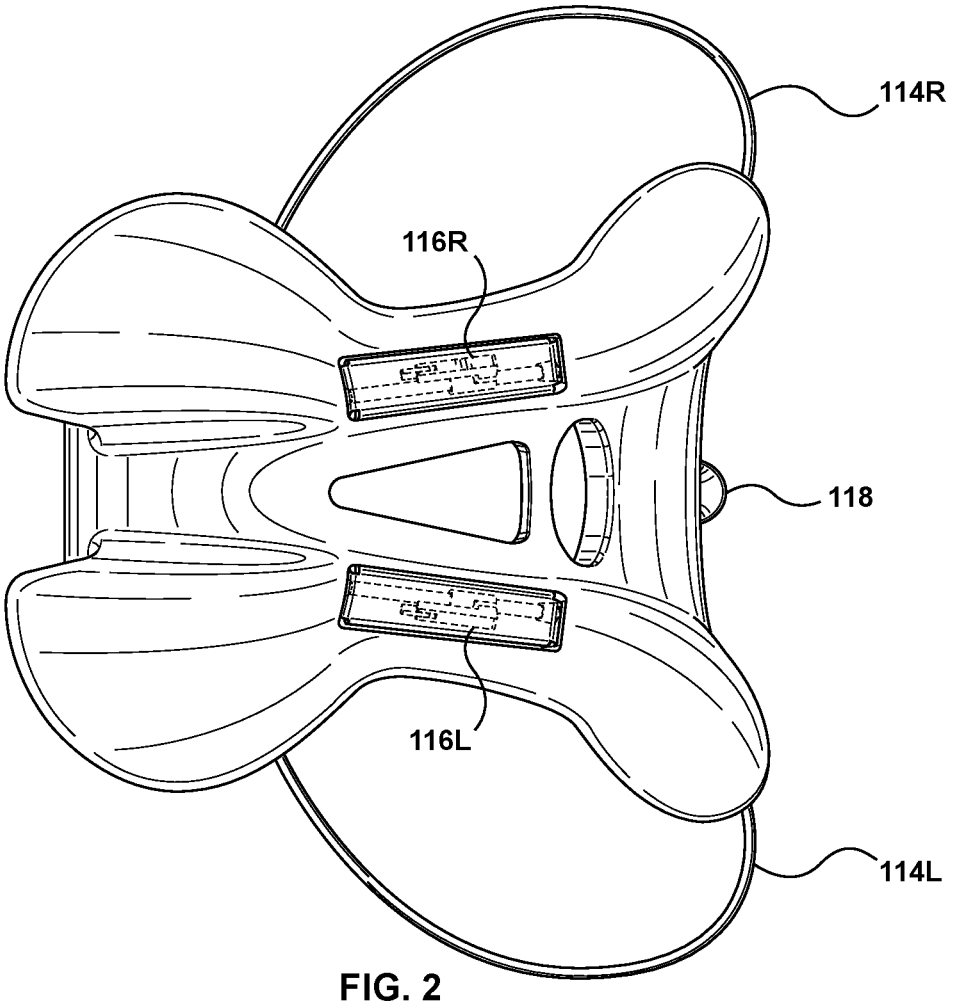
FIG. 2 illustrates, in a plan view, a bottom side of the tree of FIG. 1.

FIG. 2 illustrates, in a plan view, a bottom side of the saddle tree 101 of FIG. 1. The bottom plan view allows for illustration of the left side adjustable stirrup bar 116L installed within an aperture in the left side of the saddle tree 101 (the stirrup bars may be referenced collectively or individually as 116).

Figure 3:
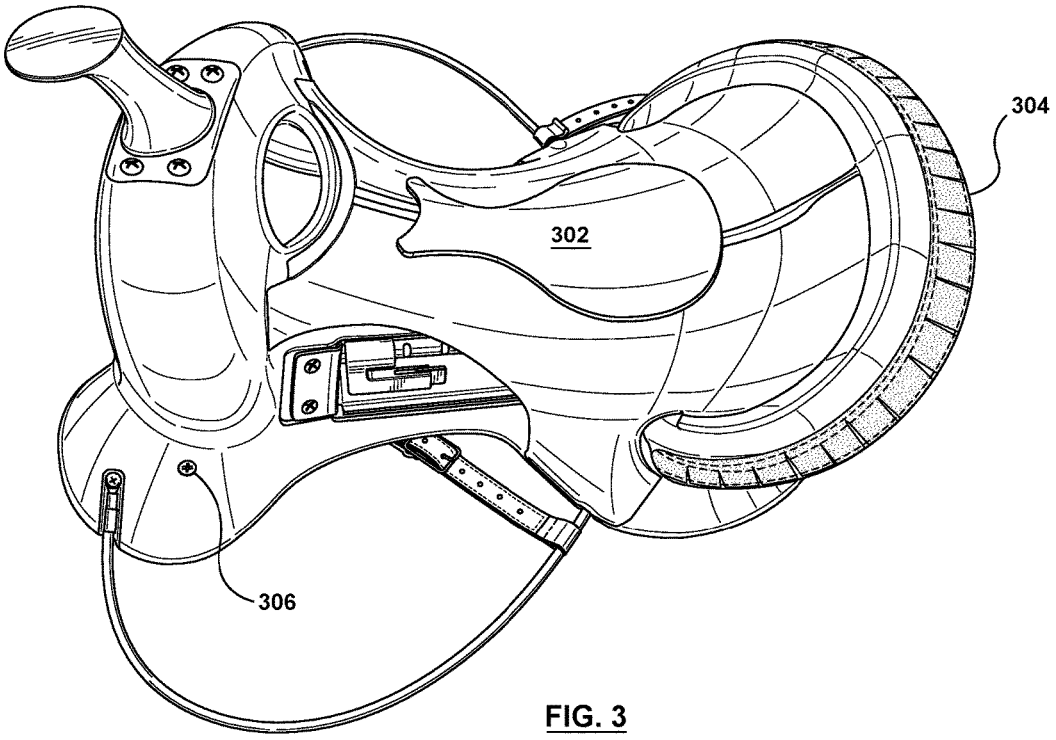
FIG. 3 illustrates, in an upper perspective view, a left side of the tree of FIG. 1, showing a seat foam preparation in accordance with an aspect of the present application.

FIG. 3 illustrates, in an upper perspective view, a left side of the saddle tree 101 of FIG. 1, showing a ground seat 302. Additionally illustrated in FIG. 3 is a cantle edge 304. The cantle edge 304 may be fastened to the saddle tree 101 in any of many ways. For example, the cantle edge 304 may be fastened to the saddle tree 101 with staples, rivets or glue, just to name a few. The saddle tree 101 is illustrated, in FIG. 3, as including a plurality of embedded nuts 306 built in to the saddle tree 101.

Figure 4:
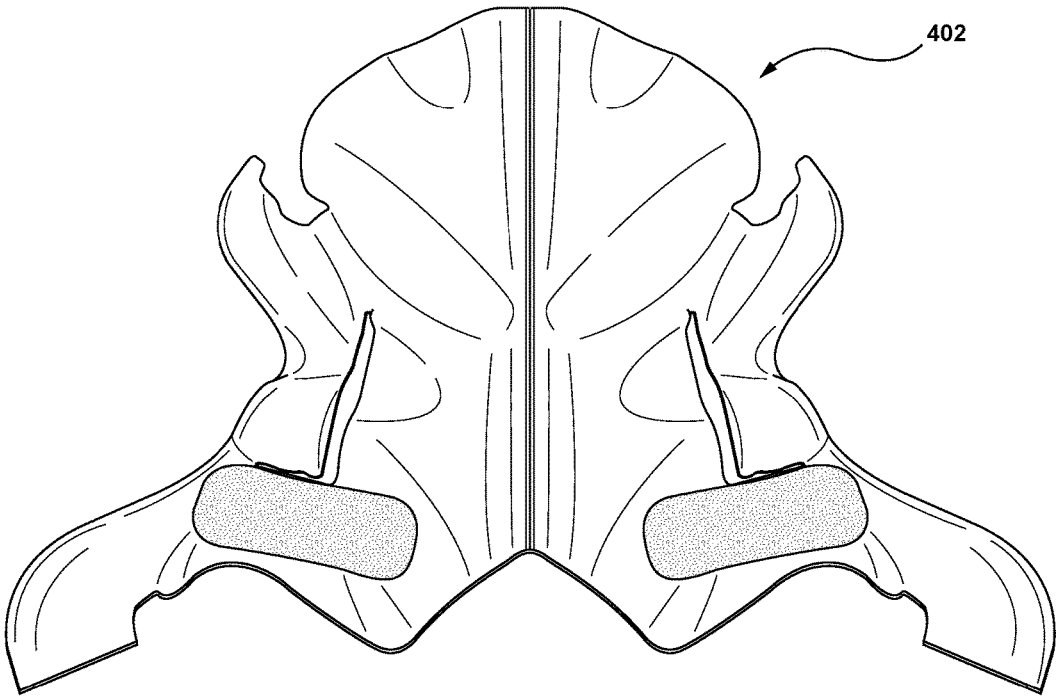
FIG. 4 illustrates a seat cover, separate from the tree of FIG. 1, in accordance with an aspect of the present application.

FIG. 4 illustrates a seat cover 402, separate from the saddle tree 101. The seat cover 402 detachably attaches to the saddle tree 101. For example, the seat cover 402 may include button holes (not shown) positioned to coincide with the locations of the embedded nuts 306 on the saddle tree 101. Alternatively or additionally, for another example, the seat cover 402 may include flexible loops (not shown) positioned on the perimeter of the seat cover 402 in locations that coincide with the locations of the embedded nuts 306 on the saddle tree 101.

Figure 5:
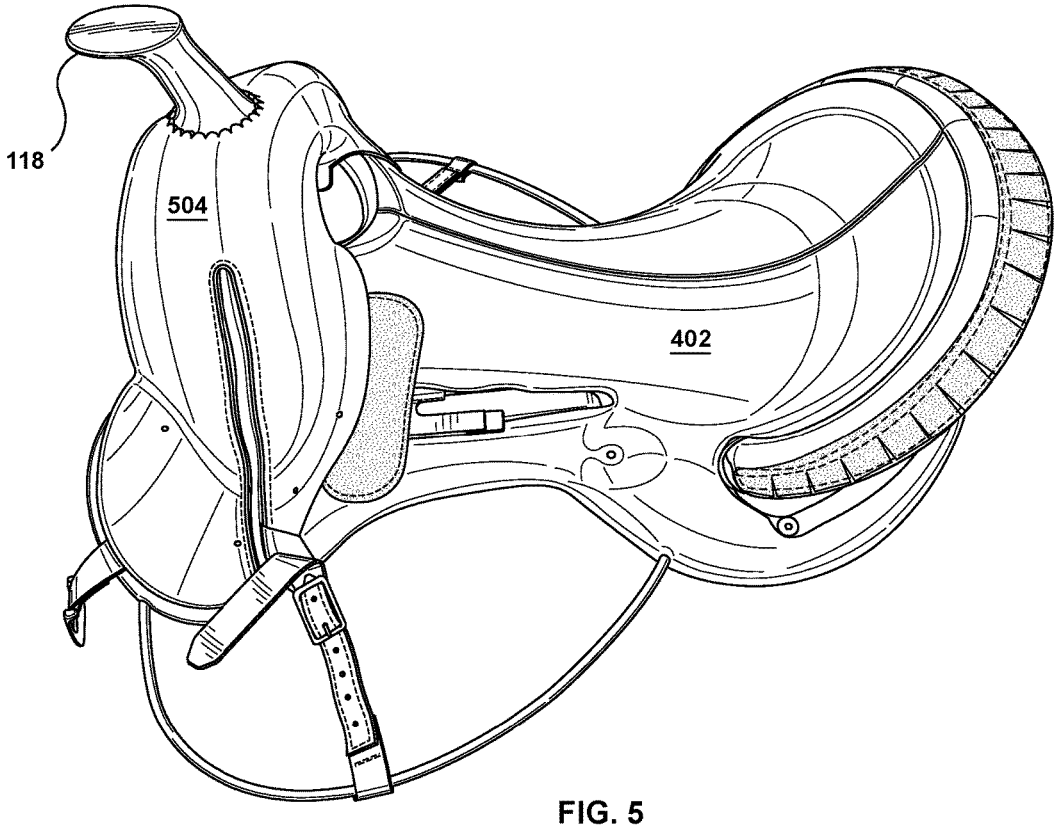
FIG. 5 illustrates, in an upper perspective view, the left side of the tree of FIG. 1, with the seat cover of FIG. 4 added in accordance with an aspect of the present application.

FIG. 5 illustrates, in an upper perspective view, the left side of the saddle tree 101 of FIG. 1, with the seat cover 402 of FIG. 4 installed. Additionally, FIG. 5 illustrates a swell cover 504 having been installed over the swell 102 of the saddle tree of FIG. 1. The swell cover 504 has an aperture sized to allow the horn 118 to pass through.

Figure 6:
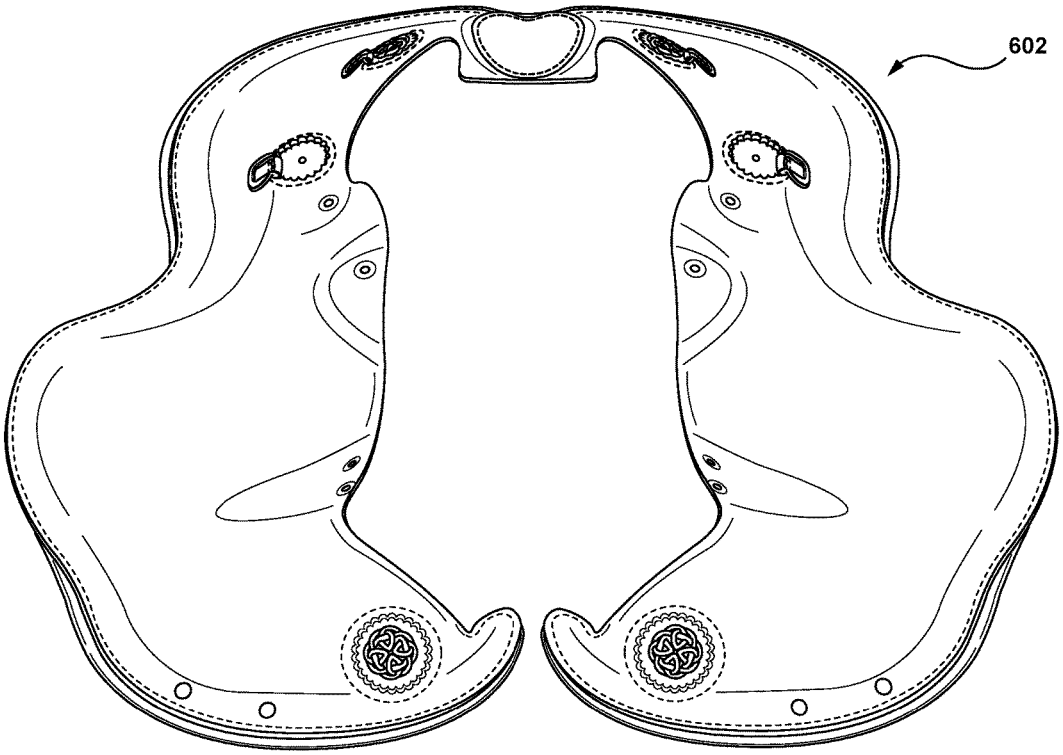
FIG. 6 illustrates a skirt, separate from the tree of FIG. 1, in accordance with an aspect of the present application.

FIG. 6 illustrates a skirt 602, separate from the saddle tree 101.

Figure 7:
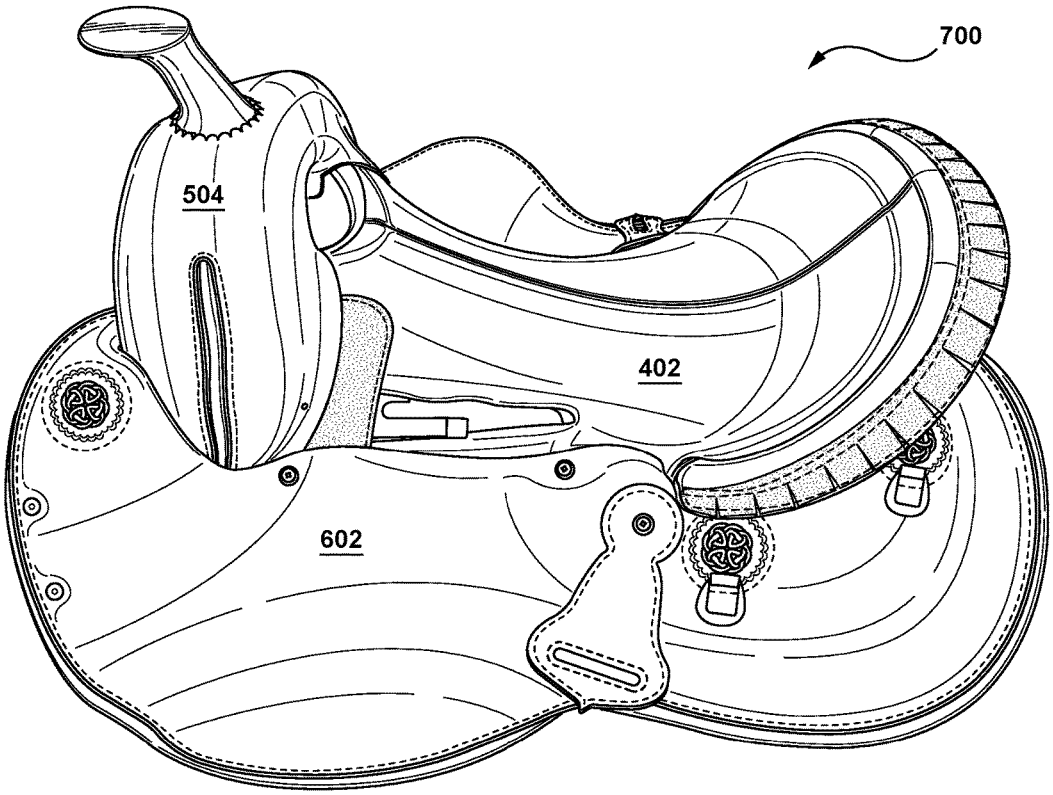
FIG. 7 illustrates, in an upper perspective view, the left side of the tree of FIG. 1, with the skirt of FIG. 6 added, thereby completing a saddle in accordance with an aspect of the present application.

FIG. 7 illustrates, in an upper perspective view, the left side of the saddle tree 101 of FIG. 1, with the skirt 602 of FIG. 6 added, thereby completing a saddle 700.

Figure 8:
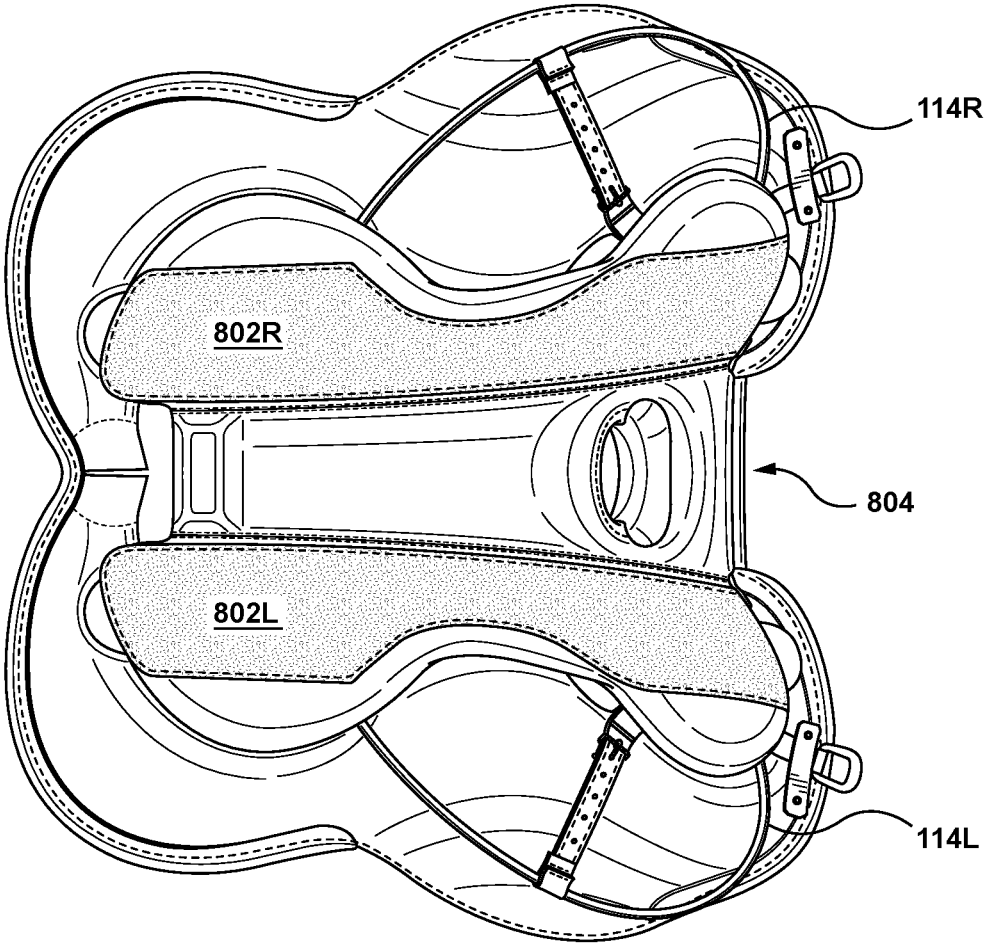
FIG. 8 illustrates, in a plan view, a bottom side of the saddle of FIG. 7.

FIG. 8 illustrates, in a plan view, a bottom (horse-facing) side of the saddle 700 of FIG. 7, as opposed to a rider-facing side. The bottom plan view allows for illustration of a right connection panel 802R and a left connection panel 802L (collectively or individually 802). The connection panels 802 may be formed of a material that allows a releasable connection of padding elements. The material may include sections of Velcro™ from Velcro USA Inc. of Manchester, N.H. The connection panels 802 may be fastened to the saddle tree 101 with staples, rivets or glue, just to name a few. The underside of the saddle 700, especially between the bars and under the swell 102, may be considered to define a gullet channel 804.

Figure 9:
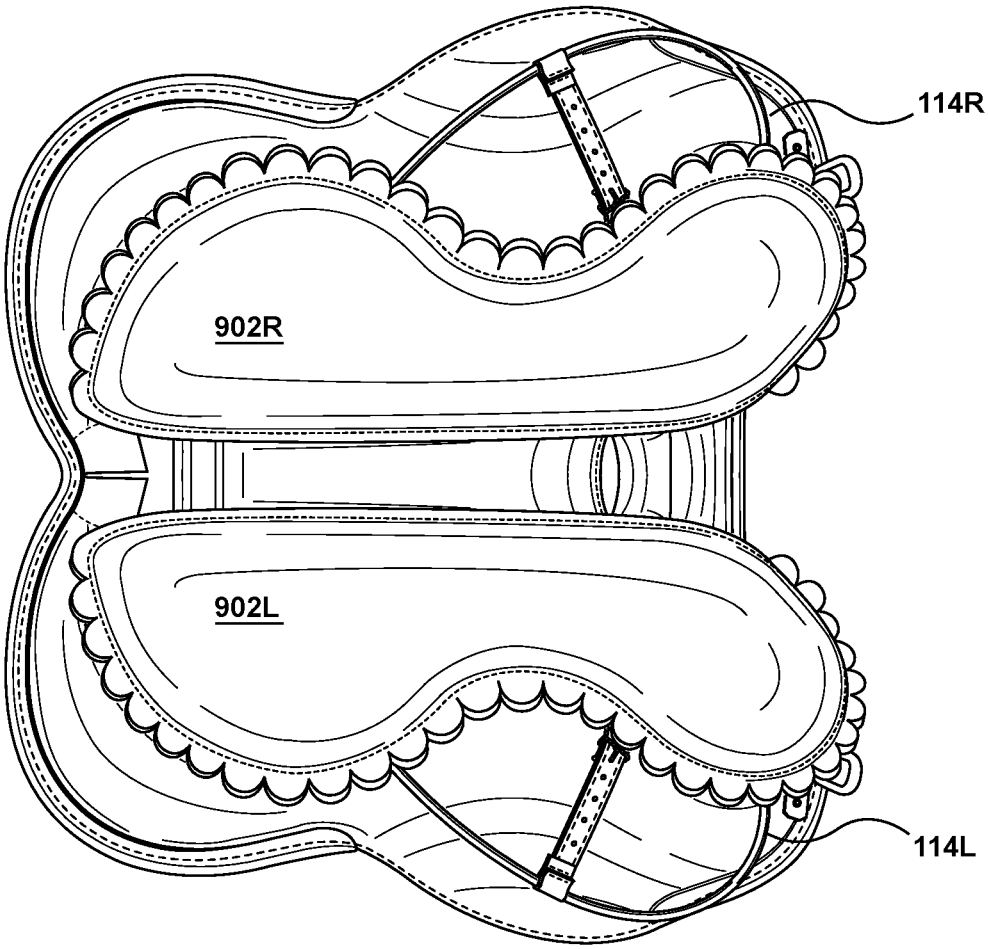
FIG. 9 illustrates, in a plan view, the bottom side of the saddle of FIG. 7.

FIG. 9 illustrates, in a plan view, the bottom side of the saddle 700 of FIG. 7, with a left panel padding element 902L and a right panel padding element 902R (individually and collectively referenced as 902) secured to the left connection panel 802L and the right connection panel 802R, respectively. The panel padding elements 902 may be formed of such materials as, for example, fleece, wool or felt. Additionally, the panel padding elements 902 may include removable and replaceable air-filled or foam-filled padding. On the side of the panel padding element 902 that attaches the panel padding element 902 to the connection panel 802, there may be a closeable slit (not shown) that allows for the insertion, or removal, of padding. Consequently, each of the panel padding elements 902 may have a customized thickness. In the case wherein the connection panels 802 include sections of "hook" Velcro™ elements, the panel padding elements 902 may include correspondingly located sections of "loop" Velcro™ elements. Alternatively, in the case wherein the connection panels 802 include sections of "loop" Velcro™ elements, the panel padding elements 902 may include correspondingly located sections of "hook" Velcro™ elements.

Figure 10:
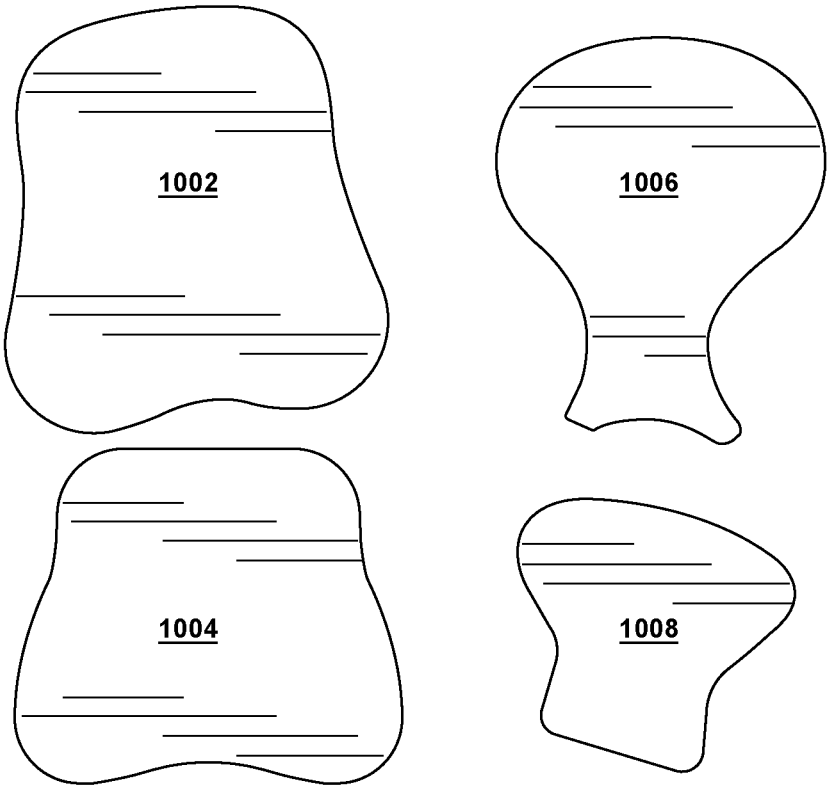
FIG. 10 illustrates four ground seats suitable for installation between the seat foam preparation of FIG. 3 and the seat cover of FIG. 4.

FIG. 10 illustrates four ground seats: a first male-specific ground seat 1002; a second male-specific ground seat 1004; a first female-specific ground seat 1006; and a second female-specific ground seat 1008. In addition to two-dimensional shape differences, the ground seats 1002, 1004, 1006 and 1008 may be distinguished from each other by three-dimensional differences. That is, padding provided by each ground seat may be thicker in some places and thinner in other places.

In overview, the present application relates to a saddle, such as the saddle 700 of FIG. 7, that may be configured and customized for a particular rider or type of rider. Conveniently, the configurability of the saddle 700 allows the saddle 700 to be custom fit for either men or women. Furthermore, the configurability of the saddle 700 allows the saddle 700 to be custom fit for the horse on which the saddle 700 will be used. The adjustable stirrup bars 116 provide even further flexibility of customization.

In consideration of an initial condition wherein the saddle 700 has been previously configured for a male rider, say, with the first male-specific ground seat 1002, the following are example steps in a method of re-configuring the saddle 700 for a female rider.

Step 1—detach the seat cover 402, as discussed hereinbefore, detaching the seat cover 402 may involve disengaging Concho screws in the seat cover 402 from embedded nuts 306 in the saddle tree 101;

Step 2—remove the first male-specific ground seat 1002 from the saddle tree 101;

Step 3—install a female ground seat, such as the first female-specific ground seat 1006, on the saddle tree 101; and Step 4—reattach the seat cover 402.

Notably, for the further comfort of female riders, the saddle tree 101 may be modified and designed to include a relatively narrow section that, in use, is positioned between the upper inner thighs of the rider in the saddle 700. This relatively narrow section may be seen to accommodate for the angle of the female hip. Furthermore, this relatively narrow section may be seen to allow for the inner thigh of the female rider to sit close to the horse.

Once the seat cover 402 has been reattached (step 4) over the first female-specific ground seat 1006, the result may be a relatively wide and relatively soft female-specific seat. The female-specific ground seat 1006 that defines the female-specific seat may be designed to accommodate a women's pelvic structure. That is, the female-specific seat in an aspect of the present application may be considered to alleviate seat bone pressure points. The female-specific seat, in an aspect of the present application, may also be considered to relieve pressure and/or rubbing on the pubic symphysis and/or the genitalia of the rider.

Notably, the pubic symphysis is a midline cartilaginous joint (secondary cartilaginous) uniting the superior rami of the left and right pubic bones. The pubic symphysis is located anterior to the urinary bladder and superior to the external genitalia. For females, the pubic symphysis is above the vulva. For males, the pubic symphysis is above the penis.

Elements of the present application include the detachable seat cover 402 in combination with the sex-specific ground seats 1002, 1004, 1006, 1008. The seat cover 402 in combination with the sex-specific ground seats 1002, 1004, 1006, 1008 may be considered to allow fine adjustment of seat cushioning for a personalized fit. The seat cover 402 in combination with the sex-specific ground seats 1002, 1004, 1006, 1008 may, in aspects of the present application, be detachable from the saddle tree 101 to allow the interchanging of the ground seat to determine male/female models.

In another aspect of the present application, the panel padding elements 902 are adjustable. The adjustability of the panel padding elements 902 may be considered to accommodate the changing three-dimensional shape of the horse's back. That is, the panel padding elements 902 may be adjusted to accommodate a change from one horse to another or may be adjusted to accommodate the same horse as that horse ages and changes shape. The saddle tree 101 may be configured to have a relatively wide gullet channel 804 (see FIG. 8). An advantage of a wide gullet channel 804 in combination with the connection panels 802 and the panel padding elements 902 may be seen to allow for a saddle underside that is customized to a particular horse. A customized saddle underside may be considered to reduce pressure on the spine and on the withers of the horse. Conveniently, preventing such pressure may be seen to alleviate contact with associated ligaments and nerves.

The withers is the ridge between the shoulder blades of a four-legged mammal. In many species, the withers is the tallest point of the body and, in horses and dogs, the withers is the standard place to measure the animal's height.

The detachable panel padding elements 902 facilitate fitting the saddle 700 to a wide range of horses' backs, thereby giving the horse comfort and freedom to move. The panel padding elements 902 can be configured so that the fit of the saddle 700 to a particular horse may be fine tuned as, over time, the particular horse changes in fitness and in age. Individual panel padding elements 902 can be arranged to fit a variety of horses and may be quickly attached to the saddle 700 as needed. Conveniently, the saddle 700 constructed in accordance with aspects of the present application may be seen to be adjustable on-site to change the arc of the saddle tree 101, the width of the saddle tree 101, the angle of the saddle tree 101 and the angulations (twists) of the panel padding elements 902.

In a further aspect of the present application, the stirrup bars 116 may be made to be adjustable, thereby assisting proper positioning of the legs of either a male rider or a female rider. As illustrated in FIG. 1, the right side adjustable stirrup bar 116R is carried on a right side post 117R. The right side post 117R is installed in the aperture in the right side of the saddle tree 101 and is fastened at each end to the saddle tree 101.

The right side adjustable stirrup bar 116R includes a hollow cylindrical portion that is sized to receive right side post 117R. The right side adjustable stirrup bar 116R also includes an arm portion that initially extends axially from the hollow cylindrical portion and then extends in manner parallel to the hollow cylindrical portion.

To provide for discrete adjustments of the right side stirrup bar 116R, the right side post 117R is provided with a channel with multiple tributaries. The tributaries may be observed as notches in FIG. 1. The channel that connects the tributaries is hidden from view in FIG. 1. The hollow cylindrical portion of the right side stirrup bar 116R may include an aperture that is tapped with a thread to accept a set screw. When the set screw is properly installed in the aperture, the set screw extends into the inside of the hollow cylindrical portion of the right side stirrup bar 116R to engage the channel or one of the tributaries of the channel in the right side post 117R.

At a first useful rest position, the right side stirrup bar 116R is positioned such that the set screw is engaged by a first one of the tributaries, such that lateral movement along the right side post 117R is prevented. To select a second useful rest position, a user manipulates the right side stirrup bar 116R in such a manner as to move the set screw along the tributary, circumferentially around the right side post 117R until the set screw is in the channel. The user may then manipulate the right side stirrup bar 116R in such a manner as to move the set screw along the channel, longitudinally along the right side post 117R. The user may then manipulate the right side stirrup bar 116R in such a manner as to move the set screw along a second one of the tributaries, thereby selecting the second useful rest position.

When formed of appropriate materials, the saddle tree 101 may have beneficial qualities, such as being lightweight, strong, moisture resistant and having a performance that is relatively immune to temperature changes.

The design of the saddle tree 101 may be based on three-dimensional measurements of the horse. When the saddle tree 101 is appropriately designed, the saddle 700 built upon the tree 100 may be seen to reduce pressure on reflex points. It may be shown that pressure on reflex points of a given horse may cause negative behavior of the given horse.

The right cable portion 114R and the left cable portion 114L may be considered to be part of a cable rigging system. It may be illustrated that full, ⅞, ¾, ⅝ or even center positioning are all achievable with the cable rigging system. The cable 114 may be considered to pull evenly from front to back and from side to side for a secure fit without over-tightening. The cable rigging system may be seen to reduce, or even eliminate, the need for a rear cinch.

The above-described implementations of the present application are intended to be examples only. Alterations, modifications and variations may be effected to the particular implementations by those skilled in the art without departing from the scope of the application, which is defined by the claims appended hereto.

What is claimed is:

1. A saddle comprising:

a tree having a rider-facing side and a horse-facing side;

a seat cover adapted for detachable installation on the rider-facing side of the tree; and a first insert adapted for installation between the tree and the seat cover, the first insert having a size and a shape configured to accommodate a male rider; and a second insert adapted for installing, interchangeably with the first insert, between the tree and the seat cover, the second insert having a size and a shape different than the size and the shape of the first insert, the second insert configured to accommodate a female rider.

2. The saddle of claim 1 further comprising a connection panel secured to the horse-facing side of the tree, the connection panel adapted to allow a releasable connection of a panel padding element.

3. The saddle of claim 2 wherein the panel padding element is releasably secured to the connection panel.

4. The saddle of claim 3 wherein the panel padding element comprises fleece.

5. The saddle of claim 3 wherein the panel padding element comprises wool.

6. The saddle of claim 3 wherein the panel padding element comprises felt.

7. The saddle of claim 3 wherein the panel padding element comprises air-filled padding.

8. The saddle of claim 3 wherein the panel padding element comprises foam-filled padding.

9. The saddle of claim 3 wherein the panel padding element includes a closeable slit to allow for removal and insertion of padding material.

10. The saddle of claim 2 wherein the connection panel comprises a section of hook and loop fasteners.

11. The saddle of claim 1 further comprising an adjustable stirrup bar.

12. The saddle of claim 1 wherein the tree comprises a combination of polyurethane and polypropylene.

13. A saddle comprising:

a tree having a rider-facing side and a horse-facing side, the tree including a plurality of embedded nuts;

a seat cover adapted for detachable installation on the rider-facing side of the tree, the seat cover defining a plurality of structures positioned to coincide with locations of the embedded nuts; and a first insert adapted for installation between the tree and the seat cover, the first insert having a size and a shape configured to accommodate a male rider; and a second insert adapted for installing, interchangeably with the first insert, between the tree and the seat cover, the second insert having a size and a shape different than the size and the shape of the first insert, the second insert configured to accommodate a female rider.

14. The saddle of claim 13 wherein the structures comprise button holes.

15. The saddle of claim 13 wherein the structures comprise flexible loops.

* * * * *